US008009131B2

(12) United States Patent
Yu et al.

(10) Patent No.: US 8,009,131 B2
(45) Date of Patent: Aug. 30, 2011

(54) LIQUID CRYSTAL DISPLAY PANEL AND TESTING SYSTEM AND METHOD THEREOF

(75) Inventors: Shan-Jen Yu, Hsin-Chu (TW); Chung-Chi Huang, Hsin-Chu (TW); Jing-Ru Chen, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 840 days.

(21) Appl. No.: 12/005,315

(22) Filed: Dec. 27, 2007

(65) Prior Publication Data

US 2008/0180592 A1 Jul. 31, 2008

(30) Foreign Application Priority Data

Jan. 30, 2007 (TW) ..... 96103426 A

(51) Int. Cl.
*G09G 3/36* (2006.01)

(52) U.S. Cl. ..... 345/87; 345/904

(58) Field of Classification Search ..... 345/87, 345/60, 76, 82, 904; 324/770
See application file for complete search history.

(56) References Cited

U.S. PATENT DOCUMENTS

| | | | | |
|---|---|---|---|---|
| 6,437,596 | B1 | 8/2002 | Jenkins et al. | |
| 6,878,517 | B1 | 4/2005 | Benson | |
| 7,012,439 | B2 | 3/2006 | Pinto et al. | |
| 7,098,987 | B1 * | 8/2006 | Jen et al. | 349/152 |
| 7,663,395 | B2 * | 2/2010 | Chang et al. | 324/760.01 |
| 2005/0024306 | A1 | 2/2005 | Murase et al. | |

FOREIGN PATENT DOCUMENTS

| | | |
|---|---|---|
| KR | 10-2006-0066355 A | 6/2006 |
| TW | 200509040 | 3/2005 |
| TW | 1232946 | 5/2005 |
| TW | 200603063 | 1/2006 |

* cited by examiner

*Primary Examiner* — Ricardo L Osorio

(74) *Attorney, Agent, or Firm* — Bacon & Thomas, PLLC

(57) ABSTRACT

A testing system of a liquid crystal display panel including a substrate, a driving circuit, a first testing pad, and a second testing pad is provided. The substrate includes a pixel array whose one side has a pixel testing area. The driving circuit is formed on the substrate and connected to the other side of the pixel testing area for providing a signal to the pixel array. The first testing pad is connected to the driving circuit. The second testing pad is connected to the pixel testing area. The testing method of the liquid crystal display panel includes: respectively testing whether the liquid crystal display panel and the pixel testing area have a defect and accordingly generating a first testing pattern and a second testing pattern; combining the first testing pattern and the second testing pattern to determine whether the defect occurs at the driving circuit or the pixel array.

10 Claims, 6 Drawing Sheets

LIQUID CRYSTAL DISPLAY PANEL AND TESTING SYSTEM AND METHOD THEREOF

This application claims the benefit of Taiwan application Serial No. 96103426, filed Jan. 30, 2007, the subject matter of which is incorporated herein by reference.

BACKGROUND OF THE INVENTION

1. Field of the Invention

The invention relates in general to a testing system and method, and more particularly to a testing system of a liquid crystal display panel and method.

2. Description of the Related Art

Liquid crystal displays are divided into two categories, namely passive matrix and active matrix, according to the driving method. However, as the demand for high-resolution and large-sized displays is ever increasing, active matrix liquid crystal display will become a main-stream product in the liquid crystal display market.

A liquid crystal display must pass the shorting bar test or the full contact test during the manufacturing process such that the functions of the liquid crystal display are assured. According to the full contact test, the function of each signal line is tested. However, due to the long testing time and the high testing cost involved, the full contact test is not suitable to large scale production.

Referring to FIG. 1, a perspective of a conventional thin film transistor-liquid crystal display (TFT-LCD) adopting shorting bar test is shown. As indicated in FIG. 1, the TFT-LCD liquid crystal display panel 1 includes a display area 2. A plurality of gate lines 5 and data lines 3 define a plurality of pixel areas on the display area 2, wherein each pixel area has a thin film transistor (TFT) 7 and a pixel electrode 9. Besides, four shorting bars 16*a*, 16*b*, 18*a* and 18*b* are disposed at the peripheral of the display area 2. The shorting bars 16*a* and 16*b* are electrically connected to the data line 3, and the shorting bars 18*a* and 18*b* are electrically connected to the gate line 5. During testing, the shorting bars 16*a*, 16*b*, 18*a* and 18*b* on the display 1 are externally connected to a testing pad (not illustrated), then the TFT-LCD is tested by a testing device via the testing pad.

Currently, most of the active matrix liquid crystal displays have a gate driver (not illustrated) and a source driver (not illustrated) on the panel for generating a gate pulse signal and a data signal respectively. As such testing method is expensive, other alternatives are thus provided. For example, the driving circuit is integrated with the substrate to form an integrated driving circuit. However, due to the difference in the design of driving circuit, the abovementioned shorting bar test and full contact test are not applicable to the testing of the integrated driving circuit.

SUMMARY OF THE INVENTION

The invention is directed to a liquid crystal display panel and a testing system and method thereof. The testing system and method are designed for the liquid crystal display panel adopting an integrated driving circuit.

According to a first aspect of the present invention, a testing system of a liquid crystal display panel is provided. The system includes a substrate, a driving circuit, a first testing pad, and a second testing pad. The substrate further includes a pixel array whose one side has a pixel testing area connected thereto. The driving circuit is formed on the substrate and is connected to the other side of the pixel testing area opposite to the pixel array for providing a signal to the pixel array. The first testing pad is connected to the driving circuit. The second testing pad is connected to the pixel testing area.

According to a second aspect of the present invention, a testing method of the liquid crystal display panel is provided. The method includes the following steps. First, a substrate including a pixel array and a driving circuit is provided, wherein one side of the pixel array has a pixel testing area connected thereto, and the driving circuit is connected to the other side of the pixel testing area opposite to the pixel array for providing a signal to the pixel array. Next, the liquid crystal display panel is tested to determine whether the liquid crystal display panel has a defect and a first testing pattern is generated accordingly. Besides, the pixel testing area is tested to determine whether the pixel testing area has a defect and a second testing pattern is generated accordingly. Last, the first testing pattern and the second testing pattern are combined to determine whether defect occurs at the driving circuit or the pixel array.

According to a third aspect of the present invention, a liquid crystal display panel including a first substrate, a liquid crystal layer and a second substrate is provided. The second substrate contains the liquid crystal layer with the first substrate. The second substrate includes a pixel array, a driving circuit, a first shorting line section, and a second shorting line section. One side of the pixel array has the pixel testing area connected thereto. The driving circuit is connected to the other side of the pixel testing area opposite to the pixel array for providing a signal to the pixel array. The first shorting line is connected to the driving circuit. The second shorting line is connected to the pixel array.

The invention will become apparent from the following detailed description of the preferred but non-limiting embodiments. The following description is made with reference to the accompanying drawings.

DETAILED DESCRIPTION OF THE INVENTION

Figure 1:
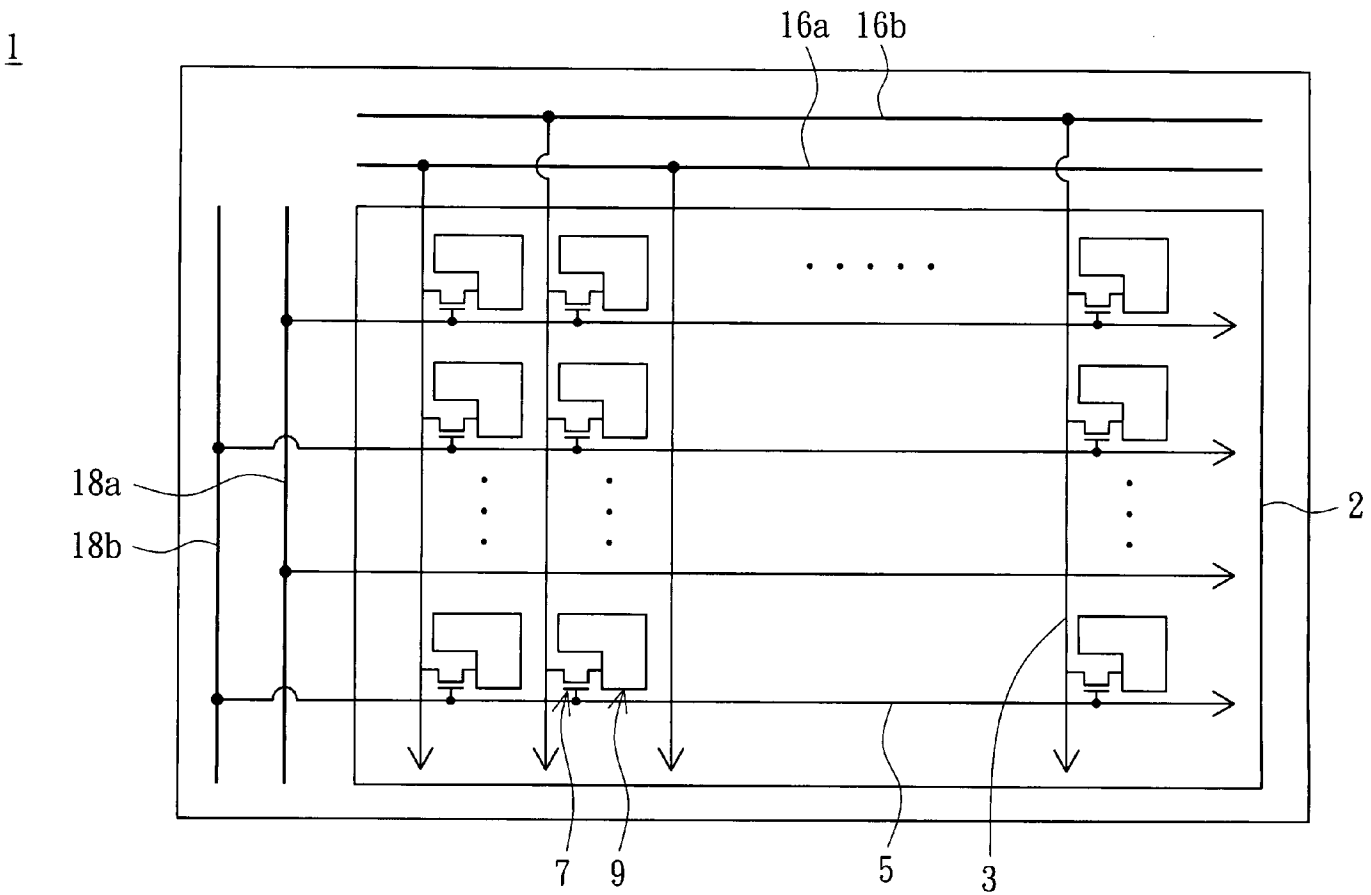
FIG. 1(RELATED ART)
FIG. 1 (Prior Art) is a perspective of a conventional TFT-LCD display adopting shorting bar test.
Figure 2:
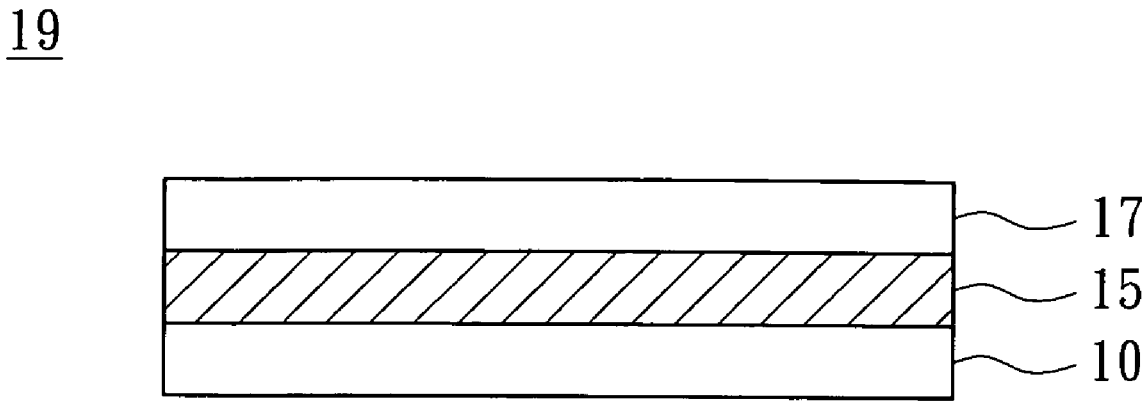
FIG. 2 is a diagram of a liquid crystal display panel of a preferred embodiment of the invention.

Referring to FIG. 2, a diagram of a liquid crystal display panel of a preferred embodiment of the invention is shown. A liquid crystal display panel 19 includes a substrate 17, a substrate 10 and a liquid crystal layer 15, wherein the substrate 17 contains the liquid crystal layer 15 with the substrate 10. In the present embodiment of the invention, the substrate 17 is exemplified by a color filter substrate, and the substrate 10 is exemplified by a thin film transistor substrate.

Figure 3:
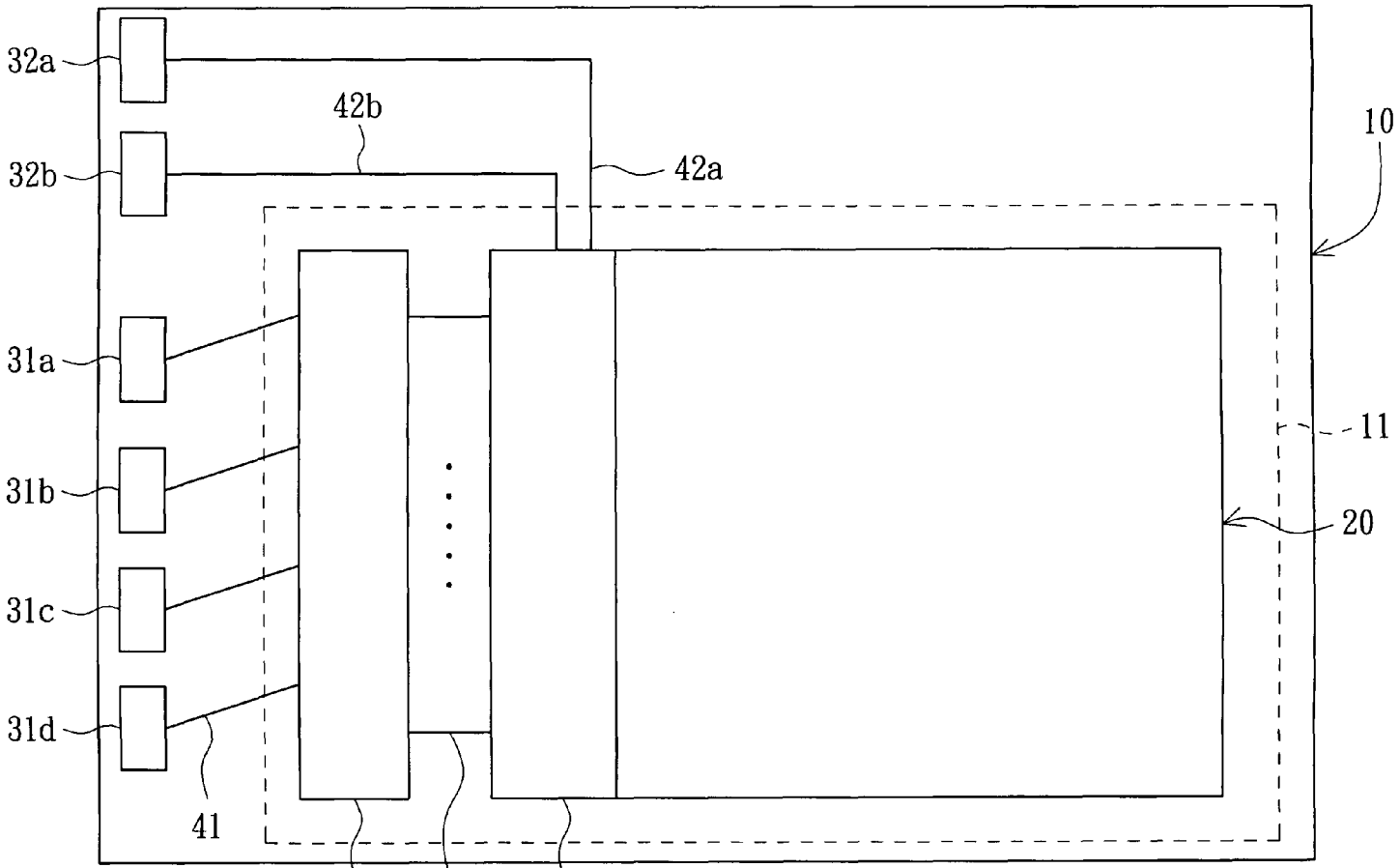
FIG. 3 is a diagram of a testing system of a liquid crystal display panel according to a preferred embodiment of the invention.

Referring to FIG. 3, a diagram of a testing system of a liquid crystal display panel according to a preferred embodiment of the invention is shown. The testing system of the liquid crystal display panel includes a substrate 10, a driving circuit 12, first testing pads 31*a*, 31*b*, 31*c* and 31*d*, and second testing pads 32*a* and 32*b*. The substrate 10 further includes a pixel array 20 whose one side has a pixel testing area 21 connected thereto. The driving circuit 12 is formed on the substrate 10 and is connected to the other side of the pixel testing area 21 opposite to the pixel array 20 for providing a signal to the pixel array 20 via a signal line 14. The first testing pads 31*a*, 31*b*, 31*c* and 31*d* are connected to the driving circuit 12. The second testing pads 32*a* and 32*b* are connected to the pixel testing area 21.

The driving circuit 12 can be a gate driver or a source driver. The pixel testing area 21 corresponds to at least one gate line or at least one data line for testing the pixel or the pixels corresponding to the pixel testing area 21. Preferably, in the present embodiment of the invention, the driving circuit 12 is a gate driver, and the second testing pads 32*a* and 32*b* are respectively a gate odd (GO) testing pad and a gate even (GE) testing pad, such that the pixel testing area 21 corresponds to at least one gate odd and at least one gate even 14. As indicated in FIG. 3, the first testing pads 31*a*, 31*b*, 31*c* and 31*d* and the second testing pads 32*a* and 32*b* are disposed outside the cutting line 11 on the substrate 10. The first testing pads 31*a*, 31*b*, 31*c* and 31*d* include a positive phase clock signal (CK) testing pad, a negative phase clock signal (XCK) testing pad, a start pulse (SP) testing pad, and a pull down (PD) testing pad. The gate driver of the present embodiment of the invention differs with the conventional gate driver additionally disposed on the panel in that the gate driver of the present embodiment of the invention is an integrated driving circuit. In practical application, a shift register whose circuiting function is equivalent to a gate driver is disposed on the substrate 10, and is called a gate driver on array (GOA) circuit.

As indicated in FIG. 3, the testing system of the liquid crystal display panel further include a first shorting line 41 and second shorting lines 42*a* and 42*b*. The first shorting line 41 is disposed on the substrate 10 for connecting the first testing pads 31*a*, 31*b*, 31*c* and 31*d* to the driving circuit 12. The second shorting lines 42*a* and 42*b* are disposed on the substrate 10 for connecting the second testing pads 32*a* and 32*b* to the pixel testing area 21.

Figure 4:
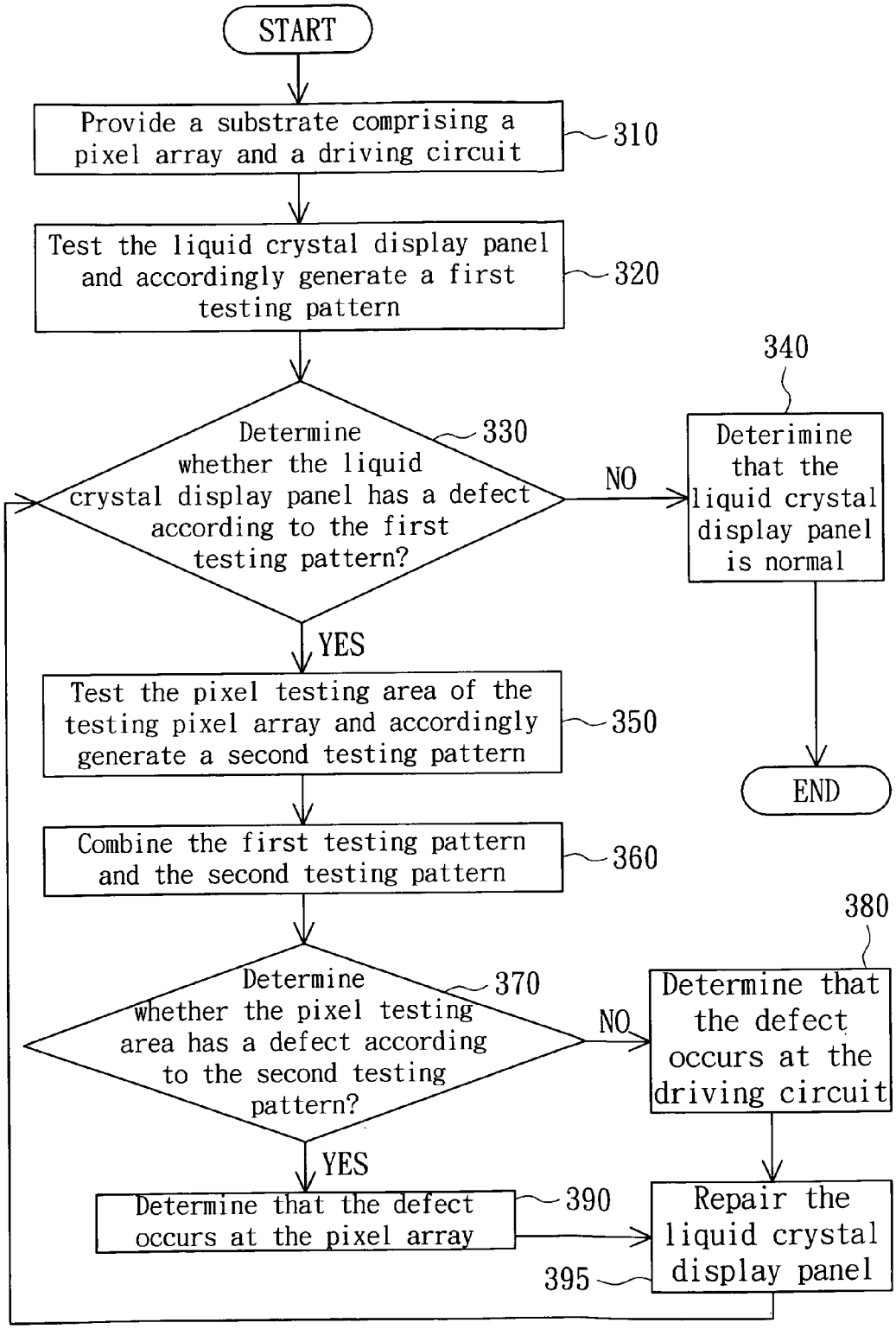
FIG. 4 is a flowchart of a testing method using the testing system of the liquid crystal display panel of FIG. 3.

Referring to FIG. 4, a flowchart of a testing method using the testing system of the liquid crystal display panel of FIG. 3 is shown. First, the method begins at step 310, a substrate 10 including a pixel array 20 and a driving circuit 12 is provided. One side of the pixel array 20 has a pixel testing area 21 connected thereto. The driving circuit 12 is disposed on the other side of the pixel testing area 21 opposite to the pixel array 20 for providing a signal to the pixel array 21. Next, the method proceeds to step 320, a first stage test is performed. In step 320, the liquid crystal display panel is tested to determine whether the liquid crystal display panel has a defect and a first testing pattern is generated accordingly. The testing of the liquid crystal display panel includes the sub-steps of providing four first testing pads 31*a*, 31*b*, 31*c* and 31*d* along with a first shorting line 41 for electrically connecting the first testing pads 31*a*, 31*b*, 31*c* and 31*d* with the driving circuit 12; and performing test via the first testing pads 31*a*, 31*b*, 31*c* and 31*d* and the first shorting line 41 by the testing device to determine whether the liquid crystal display panel has a defect according to the first testing pattern. Then, the method proceeds to step 330, the liquid crystal display panel is tested via the first testing pad 31*a*, 31*b*, 31*c* and 31*d* to determine whether the liquid crystal display panel has a defect. If no defect is determined, the method proceeds to step 340, a determination that the driving circuit 12 and the pixel array 20 are normal is made, and the method is terminated. If the first testing pattern shows that the liquid crystal display panel has a defect, then the method proceeds to step 350, a second stage test in which the pixel testing area 21 is tested and a second testing pattern is generated accordingly. The testing of the pixel testing area 21 includes the sub-steps of providing the second testing pads 32*a* and 32*b* along with second shorting lines 42*a* and 42*b* for electrically connecting the second testing pads 32*a* and 32*b* with the pixel testing area 21 of the driving circuit 12; performing test via the second testing pads 32*a* and 32*b* and the second shorting lines 42*a* and 42*b* by the testing device to determine whether the pixel testing area has a defect. Next, the method proceeds to step 360, the first testing pattern and the second testing pattern are combined. In the first stage test, the liquid crystal display panel has been determined to have a defect according to the first testing pattern. Therefore, after the second stage test is completed, the testing device can combine the first testing pattern and the second testing pattern to determine whether the defect occurs at the driving circuit 12 or the pixel array 21. That is, in step 370, if the first testing pattern of the first stage test shows that the liquid crystal display panel has a defect but the second testing pattern shows that the pixel testing area 21 has no defect, then the method proceeds to step 380 and a determination that defect occurs at the driving circuit 12 is made. To the contrary, in step 370, if the first testing pattern of the first stage test shows that the liquid crystal display panel has a defect and the second testing pattern also shows that the pixel testing area 21 has defect, then the method proceeds to step 390, a determination that defect occurs at the pixel array 20 is made. Whether the defect is occurred at the driving circuit 12 in step 380 or at the pixel array 20 in step 390, the method proceeds to step 395 to have the liquid crystal display panel repaired. Then the method goes to step 330 to check if the liquid crystal display panel still has a defect and won't terminate until the liquid crystal display panel is confirmed to be normal. Besides, after the test of the liquid crystal display panel is completed, the first testing pads 31*a*, 31*b*, 31*c* and 31*d* and the second testing pads 32*a* and 32*b* together with a part of the first shorting line 41 and the second shorting lines 42*a* and 42*b* positioned outside the cutting line 11 of the substrate 10 are cut off along the cutting line 11.

Figure 5:
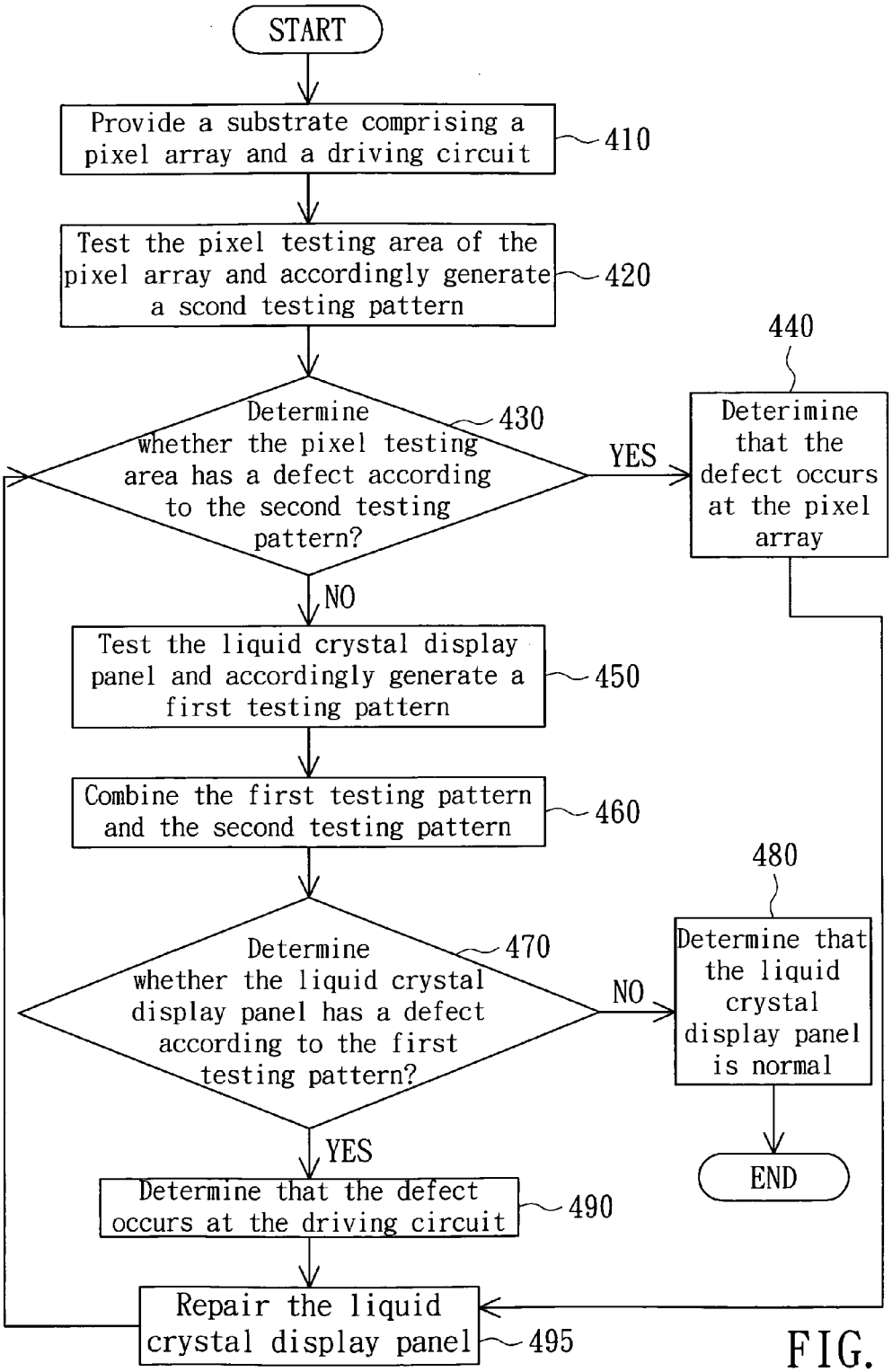
FIG. 5 is the other flowchart of a testing method using the testing system of the liquid crystal display panel of FIG. 3.

Referring to FIG. 5, the other flowchart of a testing method using the testing system of the liquid crystal display panel of FIG. 3 is shown. The main differences between the testing method of FIG. 5 and the testing method of FIG. 4 are as follows. In the testing method of FIG. 4, the step of testing the pixel testing area comes after the step of testing the liquid crystal display panel; in the testing method of FIG. 5, the step 420 of testing whether the pixel testing area has a defect comes before the step 450 of testing whether the liquid crystal display panel has a defect. That is, what is tested in the first stage test according to one testing method is tested in the second stage test according to the other testing method, and what is tested in the second stage test according to one testing method is tested in the first stage test according to the other testing method.

As indicated in FIG. 5, first, the method begins at step 410, a substrate 10 including a pixel array 20 and a driving circuit 12 is provided. One side of the pixel array 20 has a pixel testing area 21 connected thereto. The driving circuit 12 is connected to the other side of the pixel testing area 21 opposite to the pixel array 20 for providing a signal to the pixel array 21. Next, the method proceeds to step 420, a first stage test is performed. In step 420, the pixel testing area is tested to determine whether the pixel testing area has a defect and a second testing pattern is generated accordingly. The testing of the pixel testing area 21 includes the following sub-steps of providing two second testing pads 32*a* and 32*b* along with two second shorting lines 42*a* and 42*b* for electrically connecting the second testing pads 32*a* and 32*b* with the driving circuit 12; and performing test via the second testing pads 32*a* and 32*b* and the second shorting lines 42*a* and 42*b* by the testing device to determine whether the pixel testing area has a defect. Then, the method proceeds to step 430, the pixel testing area is tested via the second testing pads 32*a* and 32*b* to determine whether the pixel testing area has a defect. If a defect is determined, the method proceeds to step 440, a determination that the defect occurs at the pixel array 20 is made. If the second testing pattern shows that the liquid crystal display panel has no a defect, then the method proceeds to step 450. In step 450, a second stage test is performed, and the liquid crystal display panel is tested to determine whether the liquid crystal display panel has a defect and a first testing pattern is generated. The testing of the liquid crystal display panel includes the sub-steps of providing the first testing pads 31*a*, 31*b*, 31*c* and 31*d* along with a first shorting line 41 for electrically connecting the first testing pad 31*a*, 31*b*, 31*c* and 31*d* with the driving circuit 12; performing test via the first testing pad 31*a*, 31*b*, 31*c* and 31*d* and the first shorting line 41 by the testing device to determine whether the liquid crystal display panel has a defect according to the first testing pattern. Next, the method proceeds to step 460, the first testing pattern and the second testing pattern are combined. In the first stage test, the pixel testing area has been tested and determined to have no defect according to the second testing pattern. Therefore, after the second stage test is completed, the testing device can combine the second testing pattern and the first testing pattern and a determination that defect occurs at the driving circuit 12 or the pixel array 21 is made. That is, if the second testing pattern of the first stage test shows that the pixel testing area 21 has no defect, and the first testing pattern also shows that the liquid crystal display panel has no defect in step 470, then the method proceeds to step 480, a determination that both the pixel array 20 and the driving circuit 12 are normal is made and the method is terminated. To the contrary, if the second testing pattern of the first stage test shows that the pixel testing area 21 has no defect, but the first testing pattern of step 470 shows that the liquid crystal display panel has a defect, then the method proceeds to step 490 and a determination that the defect occurs at the driving circuit 12 is made. Likewise, Whether the defect is occurred at the driving circuit 12 in step 490 or at the pixel array 20 in step 440, the method proceeds to step 495 to have the liquid crystal display panel repaired. Then the method goes to step 430 to check if the liquid crystal display panel still has a defect and won't terminate until the liquid crystal display panel is confirmed to be normal. Likewise, after the test of the liquid crystal display panel is completed, the first testing pads 31*a*, 31*b*, 31*c* and 31*d* and the second testing pad 32*a* and 32*b* together with part of the first shorting line 41 and the second shorting line 42*a* and 42*b* positioned outside the cutting line 11 of the substrate 10 are cut off along the cutting line 11.

Moreover, according to the testing method of the preferred embodiments of the invention, the step of testing the pixel testing area and the step of testing the liquid crystal display panel may be performed at the same time and two testing patterns may be combined to determine whether defect occurs at the driving circuit 12 or the pixel array 20, and are not repeated here.

Figure 6:
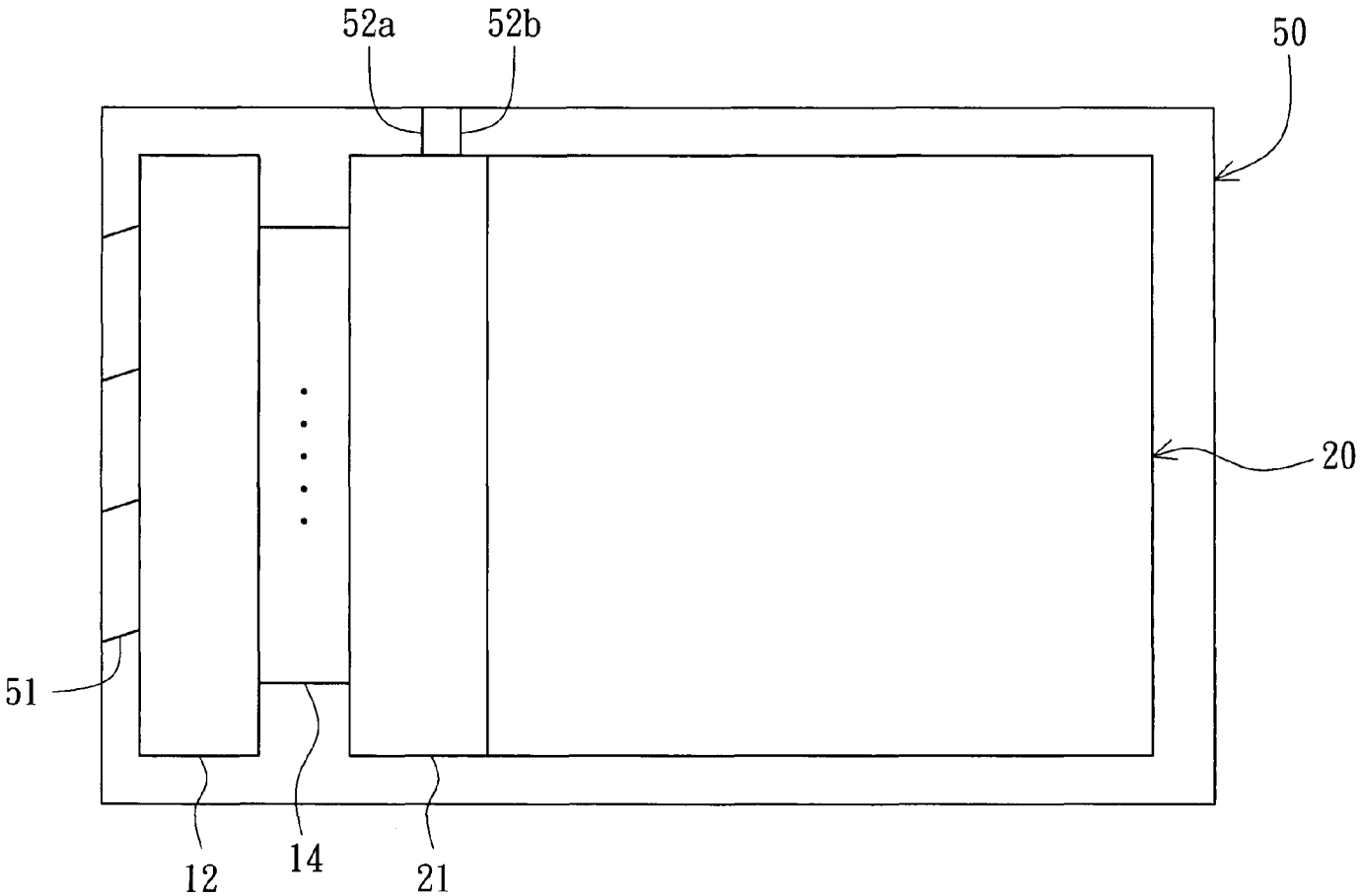
FIG. 6 is a perspective of a liquid crystal display panel according to a preferred embodiment of the invention.

Referring to FIG. 6, a perspective of a liquid crystal display panel according to a preferred embodiment of the invention is shown. The liquid crystal display panel 500 includes a pixel array 20, a driving circuit 12, a first shorting line section 51, and two second shorting line sections 52*a* and 52*b*. One side of the pixel array 20 has a pixel testing area 21 connected thereto. The driving circuit 12 is connected to the other side of the pixel testing area 21 for providing a signal to the pixel array 20. The first shorting line section 51 is connected to the driving circuit 12. The second shorting line sections 52*a* and 52*b* are connected to the pixel array 20. FIG. 6 illustrated a tested liquid crystal display panel 500 having a subscribed substrate 50. Therefore, the first shorting line section 51, and the second shorting line sections 52*a* and 52*b* are a part of the first shorting line 41 and the second shorting lines 42*a* and 42*b* of the testing system of FIG. 3 correspondingly disposed within the cutting line 11 of the substrate 10.

The liquid crystal display panel and testing system and method thereof disclosed in the above embodiments of the invention are particularly applicable to the testing of the liquid crystal display panel having an integrated driving circuit. During the manufacturing process in the above embodiments of the invention, two stage of tests are applied to the liquid crystal display panel and the pixel testing area, and whether the defect occurs at the driving circuit or the pixel array is determined according to the results of the two stage tests, such that the defect is repaired accordingly. Thus, the manufacturing costs of the liquid crystal display are largely reduced.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded to the broadest interpretation so as to encompass all such modifications and similar arrangements and procedures.

What is claimed is:

1. A testing system of a liquid crystal display panel, comprising:

a substrate comprising a pixel array whose one side has a pixel testing area connected thereto;

a driving circuit formed on the substrate and connected to the other side of the pixel testing area opposite to the pixel array for providing a signal to the pixel array;

a first testing pad connected to the driving circuit; and a second testing pad connected to the pixel testing area, wherein if the liquid crystal display panel is tested and determined to have a defect via the first testing pad but the pixel testing area is tested and determined to have no defect via the second testing pad, then a determination that the defect occurs at the driving circuit is made.

2. The testing system according to claim 1, wherein if the pixel testing area is tested and determined to have a defect via the second testing pad, then a determination that the defect occurs at the pixel array is made.

3. The testing system according to claim 1, wherein if the liquid crystal display panel is tested and determined to have no defect via the first testing pad, then a determination that both the driving circuit and the pixel array are normal is made.

4. The testing system according to claim 1, wherein the system further comprising:

a first shorting line disposed on the substrate for electrically connecting the first testing pad with the driving circuit; and a second shorting line disposed on the substrate for electrically connecting the second testing pad with the pixel testing area.

5. The testing system according to claim 1, wherein the driving circuit is a gate driver, and the pixel testing area corresponds to at least one gate line.

6. The testing system according to claim 5, wherein the second testing pad is a gate line testing pad.

7. The testing system according to claim 1, wherein the first testing pad comprises a positive phase clock signal (CK) testing pad, a negative phase clock signal (XCK) testing pad, a start pulse (SP) testing pad, and a pull down (PD) testing pad.

8. The testing system according to claim 1, wherein the second testing pad comprises a gate odd (GO) testing pad and a gate even (GE) testing pad.

9. The testing system according to claim 8, wherein the driving circuit is a gate driver, and the pixel testing area corresponds to at least one gate odd and at least one gate even.

10. The testing system according to claim 9, wherein the gate odd testing pad is electrically connected to the at least one gate odd, and the gate even testing pad is electrically connected to the at least one gate even.

* * * * *